US006755325B2

(12) United States Patent
Haase et al.

(10) Patent No.: US 6,755,325 B2
(45) Date of Patent: Jun. 29, 2004

(54) AUTOMATIC DISPENSING SYSTEM

(76) Inventors: Andreas W. Haase, 7131 SW. 8 Ct., Plantation, FL (US) 33317; Wayne R. Sampson, 13188 NW. 23 St., Pembroke Pines, FL (US) 33028

( * ) Notice: Subject to any disclaimer, the term of this patent is extended or adjusted under 35 U.S.C. 154(b) by 0 days.

(21) Appl. No.: 10/249,638

(22) Filed: Apr. 28, 2003

(65) Prior Publication Data

US 2004/0000564 A1 Jan. 1, 2004

Related U.S. Application Data

(60) Provisional application No. 60/392,740, filed on Jun. 27, 2002.

(51) Int. Cl.[7] ..... B67D 5/00

(52) U.S. Cl. ..... 222/96; 222/94; 222/105; 222/130; 222/181.1; 222/181.3; 222/182; 222/326; 222/386.5; 222/389

(58) Field of Search ..... 222/92, 94–96, 222/105, 130, 131, 180–183, 325, 326, 386–387, 389

(56) References Cited

U.S. PATENT DOCUMENTS 3,895,741 A * 7/1975 Nugent ..... 222/103
4,912,135 A * 3/1990 Taguchi et al. ..... 514/522
4,946,070 A * 8/1990 Albert et al. ..... 222/52
5,115,948 A 5/1992 Johnson
5,240,144 A * 8/1993 Feldman ..... 222/82
5,373,967 A 12/1994 Grooms et al.
5,393,153 A 2/1995 Bouthillier et al.
5,947,339 A * 9/1999 Boshears et al. ..... 222/183

* cited by examiner

*Primary Examiner*—J. Casimer Jacyna
(74) *Attorney, Agent, or Firm*—Malin, Haley & DiMaggio, P.A.

(57) ABSTRACT

The present invention relates to an automatic dispensing system capable of automatically dispensing a controlled and predetermined amount of a wide variety of products without the need for manual manipulation of the dispenser. The dispensing system includes a housing with an internal chassis contained within the housing, where said internal chassis includes a product chamber and a component chamber. The product chamber receives the dispensable product and a solenoid within the component chamber regulates the flow of the dispensable product from the product chamber. A bladder within the product chamber applies constant pressure to the dispensable product where an air pump connected to the bladder supplies air to the bladder.

32 Claims, 1 Drawing Sheet

AUTOMATIC DISPENSING SYSTEM

This patent application is based on a provisional patent application serial No. 60/392,740 entitled AUTOMATIC DISPENSING SYSTEM filed on Jun. 27, 2002.

BACKGROUND OF INVENTION

The present invention relates generally to dispensing systems. More particularly, the present invention relates to a dispensing system capable of automatically dispensing a controlled and predetermined amount of a wide variety of products without the need for manual manipulation of the dispenser.

Many products on the market today are packaged in some type of disposable tube, bottle, or other container, such as tubes of toothpaste or bottles of hair gel, shampoo, hand soap, or skin cream. Many of these containers even have a pump of some sort to assist in dispensing the product, such as the hand soap dispensers frequently found in homes. Additionally, there are many varieties of commercial dispensers, such as the soap dispensers found in the restrooms of buildings or schools.

Traditionally, the containers, whether tubes, bottles, or commercial dispensers, have required manual manipulation to dispense the product contained therein. Because tubes, bottles, and dispensers are touched and handled frequently, they often become dirty, sticky, or otherwise soiled. This results in an unsightly appearance, and may even deter persons from using them. More importantly, containers and dispensers that are frequently touched by many people can become transmittal sites for bacteria and germs.

Additionally, it is often difficult to dispense the correct amount of a product that is manually dispensed from its container. This frequently results in an over-dispensing of the product. Furthermore, many containers are such that as they are emptied, it becomes increasingly difficult to dispense the product, and the container is frequently discarded before it is completely emptied. Both the over-dispensing of a product, as well as the premature discarding of a product's container, are wasteful.

Another problem with traditional containers and dispensers is the difficulty encountered in their use by children, handicapped persons, and the elderly. Frequently, traditional containers and dispensers are rendered inaccessible to such persons because they require varying degrees of manual manipulation. Accordingly, there is a need for a dispensing system which is capable of automatically dispensing a wide variety of products without requiring any manual manipulation, thereby (1) allowing the dispenser to remain clean, (2) enabling the dispenser to consistently dispense the correct amount of a product as well as dispense all of the product contained in a container, thereby minimizing wastefulness, and (3) enabling small children, handicapped persons, and the elderly to easily use the dispenser. The present invention fulfills these needs and provides other related advantages.

BRIEF DESCRIPTION OF DRAWINGS

The accompanying drawing illustrates one embodiment of the present invention. In the drawing.

DETAILED DESCRIPTION

Figure 1:
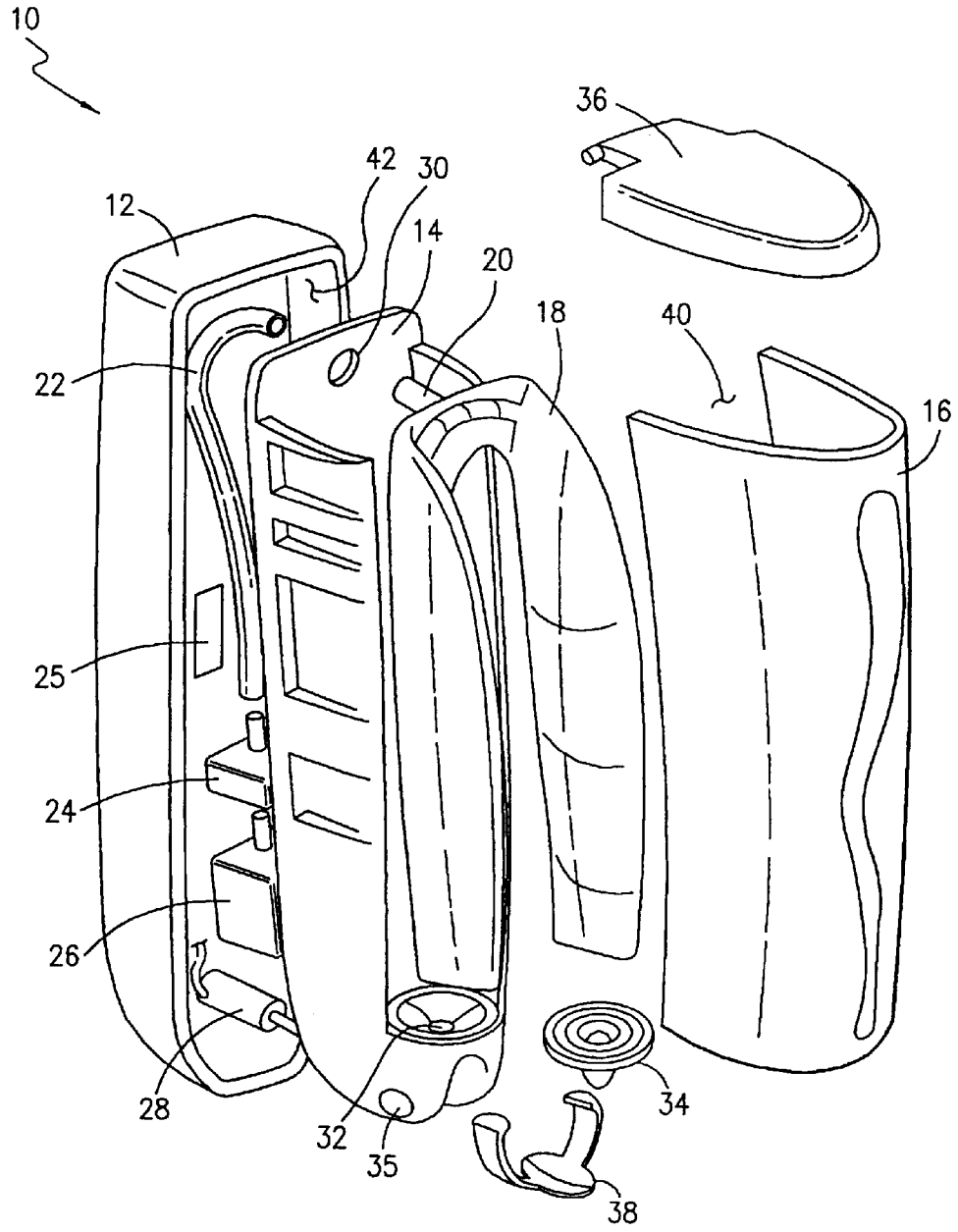
FIG. 1 is a partially-exploded perspective view of an exemplary embodiment of the present invention.

As shown in the drawing for purposes of illustration, a present invention resides in an automatic dispensing system, generally referred to by the reference number 10.

Referring to FIG. 1, the automatic dispensing system 10 generally comprises a back cover 12, a front cover 16, and a hinged top cover 36, which are the major external components of the system and which cooperatively form a housing. The system 10 is attachable to a wall or it may rest on a horizontal surface, such as a countertop, in which case a leg (not shown) extends down from the system 10 and broadens into a base which rests on the horizontal surface. An internal chassis 14 separates the interior of the dispensing system 10 into two chambers: a product chamber 40, and a component chamber 42.

Generally, an air pump 26, an air regulator 24, an air tube 22, and a solenoid 28 all reside within the component chamber 42. Additionally a computer chip 25 resides in the component chamber. The air pump 26 may be powered by AC, DC, or batteries.

An airtight bladder 18 is generally disposed within the product chamber 40. The bladder is specially formed to fit along the edges of the product chamber 40, leaving a hollow center for placement of a container of the product to be dispensed. The air bladder 18 has an inflating spout 20, which extends outwardly from the body of the air bladder, through an aperture 30 in the chassis 14, and into the component chamber 42. The inflating spout 20 attaches to the air tube 22. The air pump 26, air regulator 24, air tube 22, and air bladder 18 are sequentially connected in an airtight fashion, forming a closed system, such that air can flow from the air pump 26, through the air regulator 24 and air tube 22, and into the air bladder 18 without leakage.

At the bottom of the product chamber 40, an aperture 32 communicates with the outside. A removable rubber spout 34 fits in the bottom of the product chamber 40 and extends through the aperture 32. The spout 34 is a soft, washable, electrometric membrane, and may be discarded from time to time and replaced with a new one, thereby ensuring the system's cleanliness.

To make the automatic dispensing system 10 ready for use, the hinged top cover 36 is opened and a tube or other container of the product desired to be dispensed is placed into the product chamber 40. The tube or container must be placed so that its nozzle or opening fits into, and attaches to, the rubber spout 34 such that the product is dispensed through the spout. The hinged top cover 36 is then closed, and at this point, no further manual manipulation of any kind is required to dispense the product. When the top cover 36 is closed, the air bladder 18 is inflated until the operating air pressure level is reached. This air pressure level is high enough to pressurize the product container in the product chamber 40 such that the product readily flows out of the dispensing system 10 during dispensation. The manner of inflation is described in greater detail herein below. The air regulator 24 is equipped with an air pressure gauge and keeps the air pressure in the dispensing system 10 at a constant level. When the pressure level drops after dispensation of the product or replacement of the product container, the air regulator 24 allows additional air from the air pump 26 to enter the air tube 22 and the air bladder 18 until the operating air pressure level is again reached.

When a dispensation of product is desired, a person merely has to place his or her hand, a toothbrush, or other appropriate receptacle directly beneath the rubber spout 34. An infrared sensor 35 detects the presence of the hand, toothbrush, or other receptacle, and relays this information to the computer chip 25. Upon being informed by the infrared sensor 35 that a receptacle of some kind is awaiting dispensation, the computer chip 25 activates the solenoid 28.

In an alternative embodiment, a switch may be depressed to initiate dispensation.

The solenoid 28 is designed to pinch the rubber spout 34, thereby closing it off and preventing dispensation of the product. When the solenoid is activated by the computer chip 25, it releases its grip on the rubber spout 34, thereby temporarily allowing the spout to open up. When the spout is opened up, the product, which is under pressure from the air bladder 18, is dispensed out of the rubber spout 34. The solenoid 28 allows the rubber spout 34 to remain open for a certain, predetermined period of time, usually brief. The longer the time, the greater the amount of product dispensed. At the end of the time period, the solenoid 28 again pinches the rubber spout 34, thereby closing it off and preventing further dispensing of the product.

After the product has been dispensed, and the solenoid 28 again closes the rubber spout 34, the computer chip 25 activates the air pump 26. The air pump immediately begins pumping air through the air regulator 24 and into the air tube 22 and air bladder 18 until the air regulator 24 senses the operating air pressure level has been reached. The air pump 26 then stops pumping and the system 10 is ready to dispense more product upon the infrared sensor 35 being activated by a hand, toothbrush, or other appropriate receptacle.

It is contemplated that a dial, not shown, will reside on the exterior of the back cover 12 and allow a person to select the amount of product to be dispensed with each dispensation. The dial will communicate with the computer chip 25, which will in turn control the duration of time the solenoid 28 allows the rubber spout 34 to remain open. In this way, the dispensing system 10 may dispense any desired amount of product, ranging from a very small amount of toothpaste for a child, for example, to a large amount of hand cleaner for use in a garage. This also allows the dispensing system 10 to accommodate a wide variety of products having different viscosities.

An optional, removable drip tray 38 is attachable to the bottom of the chassis 14 and serves two functions: (1) it assists children, handicapped persons, the elderly, or others in guiding a toothbrush into the proper position for receiving the product as it is dispensed; and (2) it acts as a receptacle for product that may be inadvertently dispensed.

A container of product residing in the product chamber 40 is incrementally and gradually emptied until it is substantially empty, at which point a momentary switch (not shown) automatically deflates the air bladder 18 to allow for removal of the empty container and replacement with a new one. Additionally, at any time previous to that point, if desired, the container may be removed from the product chamber 40 and replaced with a new container of the same or a different product. To remove a container, a person may manually activate the momentary switch, thereby deflating the air bladder 18. With the air bladder deflated, the top cover 36 may be opened, and the product container removed from the product chamber 40. A new container of product may then be placed in the product chamber, and the top cover closed. As described hereinabove, at this point, no further manual manipulation is needed and the air bladder 18 automatically re-inflates until the operating air pressure level is again reached. The system 10 is then ready for dispensation.

In another embodiment of the present invention, there is no need for a momentary switch. Merely opening the top cover 36 sends a signal to the computer chip 25, which in turn causes the air bladder 18 to deflate.

It is further contemplated that the present invention will include a product container of its own. The container will generally comprise a bag or tube having a sealable opening through which any of a wide variety of products may be poured or squeezed into the bag or tube. The bag or tube will also have a nozzle at one end adapted to fit securely into the rubber spout 34. The bag or tube will be washable and reusable and allow a person to use the automatic dispensing system 10 to dispense whatever product he or she wishes; for example, shampoo, soap, lotion, and all sorts of salon products may be dispensed. Mechanics could employ the dispensing system 10 in garages to dispense industrial-strength soaps or cleaners. The dispensing system 10 could also be used as a soap dispenser in restrooms in schools or commercial buildings. Additionally, because of its highly sanitary nature, the system 10 is especially adaptable to medical uses, such as the dispensing of lotions and creams in OB/GYN offices and other areas where hygiene is so important.

Additionally, it is contemplated that the exterior components of the dispensing system 10, especially the back cover 12, the top cover 36, and the front cover 16, may be formed in such a way as to allow a variety of decorations and accessories to be attached thereto. For instance, it is contemplated that the dispensing system 10 could include attachable accessories such as toothbrushes, holders, built-in floss dispensers, night-lights, clocks, timers, and other accessories, including a wide variety of cosmetic variations.

The present invention provides a more durable and reliable dispensing system than prior art due to its minimal number of moving parts. Furthermore, dispensing system 10 allows a user to easily dispense products without any manual manipulation and therefore provides for efficient use of the enclosed product and a more sterile dispensing environment.

Although several embodiments have been described in detail for purposes of illustration, various modifications may be made without departing from the scope and spirit of the invention.

What is claimed is:

1. An automatic dispensing system for dispensing a predetermined amount of a dispensable product comprising:

a housing;

an internal chassis contained within the housing, where said internal chassis includes a product chamber and a component chamber, where said product chamber receives the dispensable product;

a solenoid within the component chamber, said solenoid regulating a flow of the dispensable product from the product chamber;

a bladder within the product chamber, where bladder applies constant pressure to the dispensable product within the product chamber;

an air pump connected to the bladder where said air pump supplies air to the bladder; and a power source which supplies power to the solenoid and air pump.

2. The automatic dispensing system of claim 1, where an air regulator is connected between the bladder and air pump.

3. The automatic dispensing system of claim 2, where a computer chip controls the air regulator and solenoid.

4. The automatic dispensing system of claim 2, where an air tube connects the air regulator to the bladder.

5. The automatic dispensing system of claim 1, where the solenoid prevents the flow of dispensable product in a first position and allows the flow of dispensable product in a second position.

6. The automatic dispensing system of claim 5, where the solenoid is activated into the second position in response to a sensor, when the sensor detects the presence of a receptacle for the dispensing product.

7. The automatic dispensing system of claim 6, where the sensor is an infrared sensor.

8. The automatic dispensing system of claim 5, where the solenoid is activated into the second position in response to a switch.

9. The automatic dispensing system of claim 6, where the solenoid remains in the second position for a predetermined time period.

10. The automatic dispensing system of claim 9, where the solenoid returns to the first position after expiration of the predetermined time period.

11. The automatic dispensing system of claim 9, where the predetermined time period is set by a user.

12. The automatic dispensing system of claim 11, where the user uses a dial to set the predetermined time period, where the dial is attached to the exterior of the housing.

13. The automatic dispensing system of claim 8, where the solenoid remains in the second position for a predetermined time period.

14. The automatic dispensing system of claim 13, where the solenoid returns to the first position after expiration of the predetermined time period.

15. The automatic dispensing system of claim 14, where the predetermined time period is set by a user.

16. The automatic dispensing system of claim 15, where the user uses a dial to set the predetermined time period, where the dial is attached to the exterior of the housing.

17. The automatic dispensing system of claim 4, where the bladder surrounds the dispensable product.

18. The automatic dispensing system of claim 17, where the bladder fits along the edges of the product chamber and leaves a hollow center for placement of the dispensable product, and wherein the bladder includes an inflating spout which extends into the component chamber and attaches to the air tube.

19. The automatic dispensing system of claim 2, where the air regulator ensures a constant supply of air flow to the air bladder in order to achieve an operating air pressure.

20. The automatic dispensing system of claim 19, where the air pressure increases in proportion to the amount of product dispensed.

21. The automatic dispensing system of claim 1, where the housing includes a front cover, a back cover and a hinged top cover.

22. The automatic dispensing system of claim 1, where a removable drip tray attaches to a product dispensing end of the product chamber.

23. The automatic dispensing system of claim 3, where the bladder deflates upon reaching a predetermined pressure and allows for the removal of a container of the dispensable product.

24. The automatic dispensing system of claim 21, where the bladder deflates upon the removal of the hinged top cover.

25. The automatic dispensing system of claim 24, where the air flow from the air pump to the bladder is activated upon closure of the hinged top cover.

26. The automatic dispensing system of claim 1, where the power source includes at least one of an AC power source and a DC power source.

27. The automatic dispensing system of claim 1, where the product chamber includes an aperture at a product dispensing end and a removable rubber spout fitted into the product dispensing end and extending through the aperture.

28. An automatic dispensing system for dispensing a predetermined amount of a dispensable product comprising:

a housing;

an internal chassis contained within the housing, where said internal chassis includes a product chamber and a component chamber, where said product chamber includes a product container for receiving the dispensable product, and where the product chamber includes an aperture at a product dispensing end and a removable rubber spout fitted into the product dispensing end and extending through the aperture;

a solenoid within the component chamber, where the solenoid prevents the flow of dispensable product in a first position and allows the flow of the dispensable product in a second position, where a computer chip controls the movement of the solenoid between the first position and the second position;

a bladder within the product chamber, where bladder applies constant pressure to the product container within the product chamber;

an air pump connected to the bladder where said air pump supplies air to the bladder, where an air regulator connects to the air pump and controls the air supply to the bladder; and a power source which supplies power to the solenoid and air pump.

29. The automatic dispensing system of claim 28, where the product container is at least one of a bag and a tube.

30. The automatic dispensing system of claim 28, where the product container includes a sealable opening end and a nozzle end where the nozzle end fits securely into the rubber spout.

31. The automatic dispensing system of claim 30, where the solenoid applies pressure to the rubber spout while in the first position and releases the applied pressure while in the second position.

32. The automatic dispensing system of claim 31, where the solenoid remains in the second position for a predetermined period of time.

* * * * *